US009549604B2

(12) United States Patent
Liu

(10) Patent No.: US 9,549,604 B2
(45) Date of Patent: Jan. 24, 2017

(54) MULTIFUNCTIONAL COSMETIC APPLICATOR

(71) Applicant: CHUEN CHURN CO., LTD., New Taipei (TW)

(72) Inventor: Li-Mei Liu, New Taipei (TW)

( * ) Notice: Subject to any disclaimer, the term of this patent is extended or adjusted under 35 U.S.C. 154(b) by 0 days.

(21) Appl. No.: 14/696,900

(22) Filed: Apr. 27, 2015

(65) Prior Publication Data

US 2016/0309881 A1 Oct. 27, 2016

(51) Int. Cl.

| | |
|---|---|
| ***B05C 1/00*** | (2006.01) |
| ***A45D 40/24*** | (2006.01) |
| ***A45D 40/04*** | (2006.01) |
| ***A45D 40/20*** | (2006.01) |
| *A45D 34/06* | (2006.01) |

(52) U.S. Cl.

CPC ..... *A45D 40/24* (2013.01); *A45D 40/04* (2013.01); *A45D 40/205* (2013.01); *A45D 34/06* (2013.01); *A45D 2040/208* (2013.01)

(58) Field of Classification Search

CPC ..... A45D 40/04; A45D 40/24; A45D 34/06

USPC ..... 401/17, 19

See application file for complete search history.

(56) References Cited

U.S. PATENT DOCUMENTS

| | | | | |
|---|---|---|---|---|
| 8,662,775 | B1 * | 3/2014 | Liu | A45D 40/04 401/17 |
| 2009/0110464 | A1 * | 4/2009 | Zhang | A45D 40/06 401/18 |

* cited by examiner

*Primary Examiner* — Jennifer C Chiang

(57) ABSTRACT

A cosmetic applicator includes a hollow seat including a projecting axial sleeve, a threaded shank moveably disposed through the sleeve, a cup at an end of the threaded shank, and slits on the cup; a casing secured to the seat, the casing being configured to receive the threaded shank and including ribs on an inner surface, the ribs being inserted into the slits; a first activation assembly including an exterior case secured to the seat, an interior case, a sleeve member, a sleeve element, first external threads on an inner surface of the exterior case, a first flange at an end of the interior case, second external threads on an inner surface of the interior case, a hollow cylinder in the interior case, and a second flange at a first end of the hollow cylinder; and a hollow intermediate case secured onto the first and a second activation assemblies.

8 Claims, 11 Drawing Sheets

MULTIFUNCTIONAL COSMETIC APPLICATOR

BACKGROUND OF THE INVENTION

1. Field of the Invention

The invention relates to cosmetic products and more particularly to a multifunctional cosmetic applicator, i.e., three-in-one cosmetic applicator.

2. Description of Related Art

There are a wide variety of cosmetic products commercially available. For example, a conventional cosmetic applicator is shown in FIG. 11. The cosmetic applicator comprises a casing 80, a first activation module 81, an application module 85, a cap 87, and a second activation module 88. The first activation module 81 includes a rotation ring 82 configured to rotate in a sleeve member 82 by rotating the sleeve member 82, and a plunger 84 configured to move downward in response to rotating the rotation ring 82. Then lip lotion stored in a first space (not shown) of the casing 80 flows to discharge tube 86 of the application module 85 for application. Further, the second activation module 88 includes a rotation tube 92, a sliding member 91 in the rotation tube 92, a hollow member 90 put on the sliding member 91 so that the rotation tube 92 and the hollow member 90 can co-rotate, and a tubing member 89 with the sliding member 91 rotating therein by threading. And in turn, a lipstick 93 in the rotation tube 92 can project out of the rotation tube 92 for application.

While the conventional cosmetic applicator enjoys its success in the market, continuing improvements in the exploitation of cosmetic applicator of this type are constantly sought. For example, the conventional cosmetic applicator includes an externally threaded tube at one end, and the sliding member at the other end configured to cooperate with the externally threaded tube, and the casing 80 having an empty central portion for separating components at one end from components at the other end, resulting in a bulkiness of the conventional cosmetic applicator and less portability.

SUMMARY OF THE INVENTION

It is therefore one object of the invention to provide a cosmetic applicator comprising a hollow seat including a projecting axial sleeve, a threaded shank moveably disposed through the sleeve, a cup formed at an end of the threaded shank, and a plurality of slits formed on a peripheral surface of the cup; a casing secured to the seat and having a bottom extended into the seat, the casing being configured to receive the threaded shank and including a plurality of ribs on a conic inner surface, the ribs being inserted into the slits to fasten the casing and the cup together; a first activation assembly including an exterior case having an end secured to a bottom of the seat, an interior case, a sleeve member, a sleeve element, first external threads formed on an inner surface of the exterior case, a first flange formed at an end of the interior case and configured to move along the first external threads, second external threads formed on an inner surface of the interior case and spiraled in a direction opposite to that of the first external threads, a hollow cylinder disposed in the interior case, and a second flange formed at a first end of the hollow cylinder and configured to move along the second external threads wherein the sleeve member is disposed at a second end of the hollow cylinder; and a hollow intermediate case having a first end secured onto the first activation assembly, and a second end secured onto a second activation assembly, the second end of the intermediate case being opposite to the first end of the intermediate case.

The above and other objects, features and advantages of the invention will become apparent from the following detailed description taken with the accompanying drawings.

DETAILED DESCRIPTION OF THE INVENTION

Figure 1:
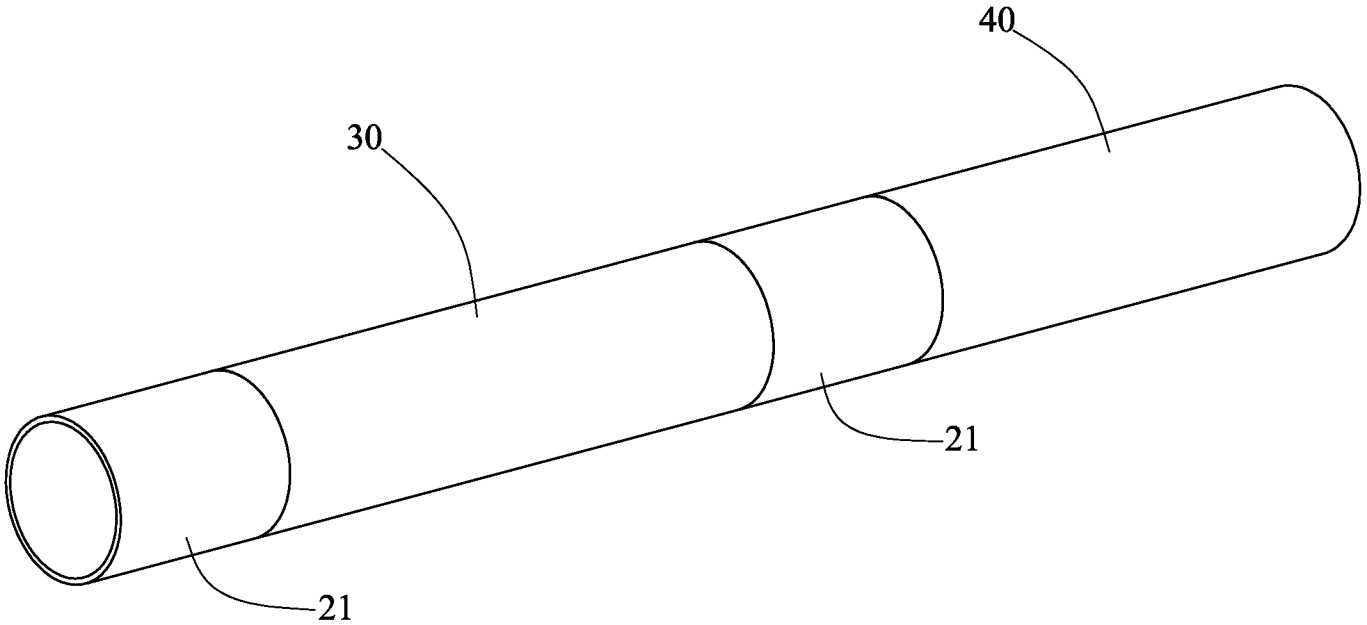
FIG. 1 is a perspective view of a multifunctional cosmetic applicator according to the invention.
Figure 2:
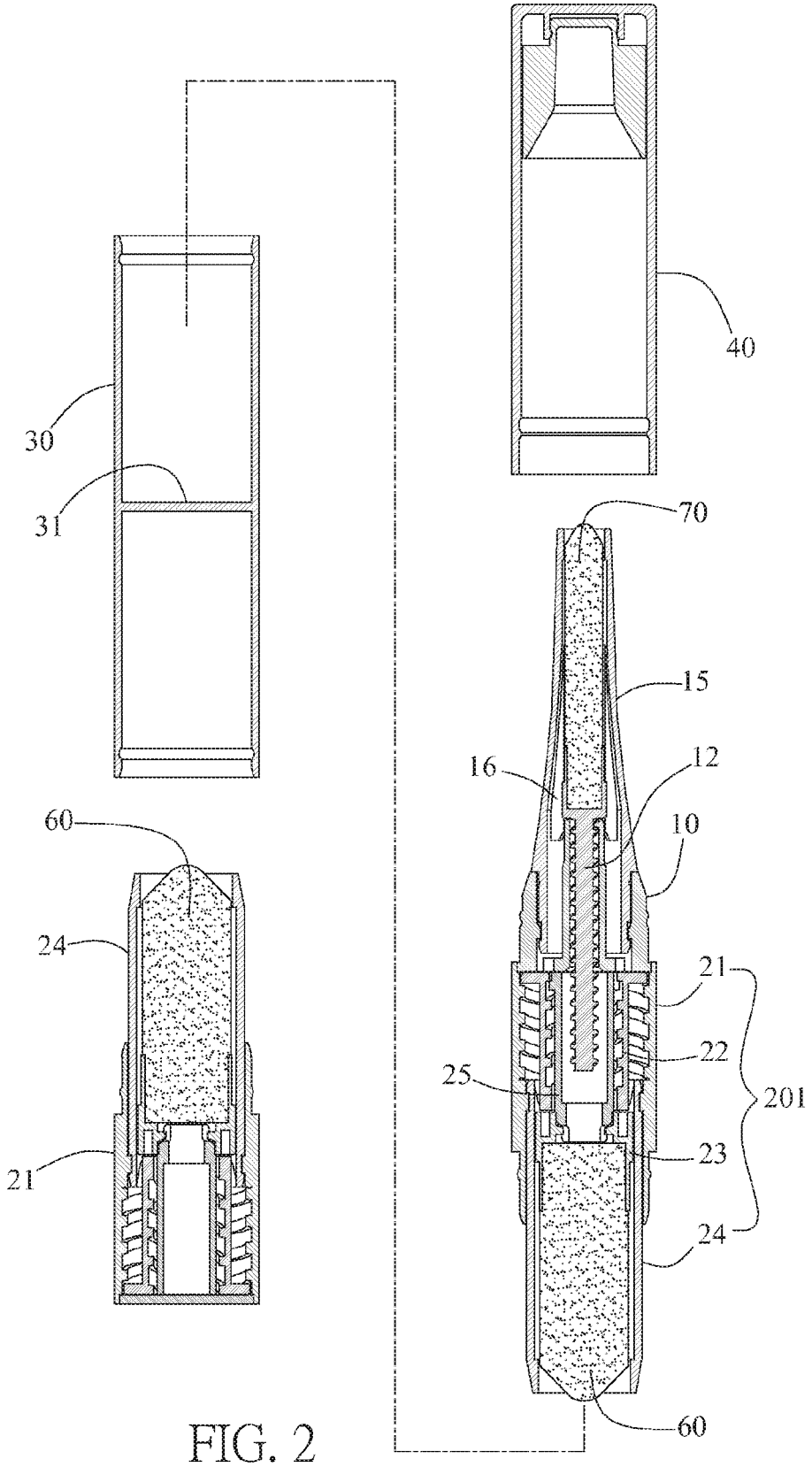
FIG. 2 is a longitudinal sectional, exploded view of the components of the cosmetic applicator.
Figure 3:
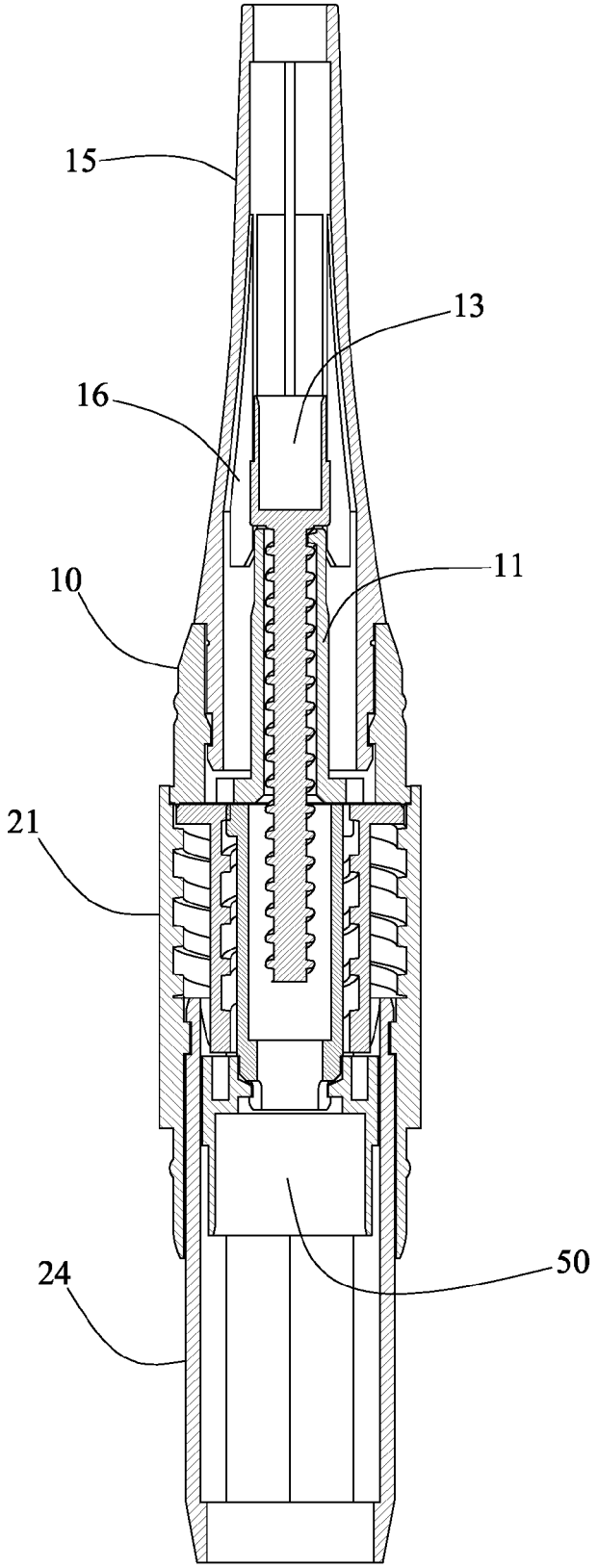
FIG. 3 is an enlarged view of the component under the cap of FIG. 2 with both the lip gloss and cosmetic substance removed.
Figure 4:
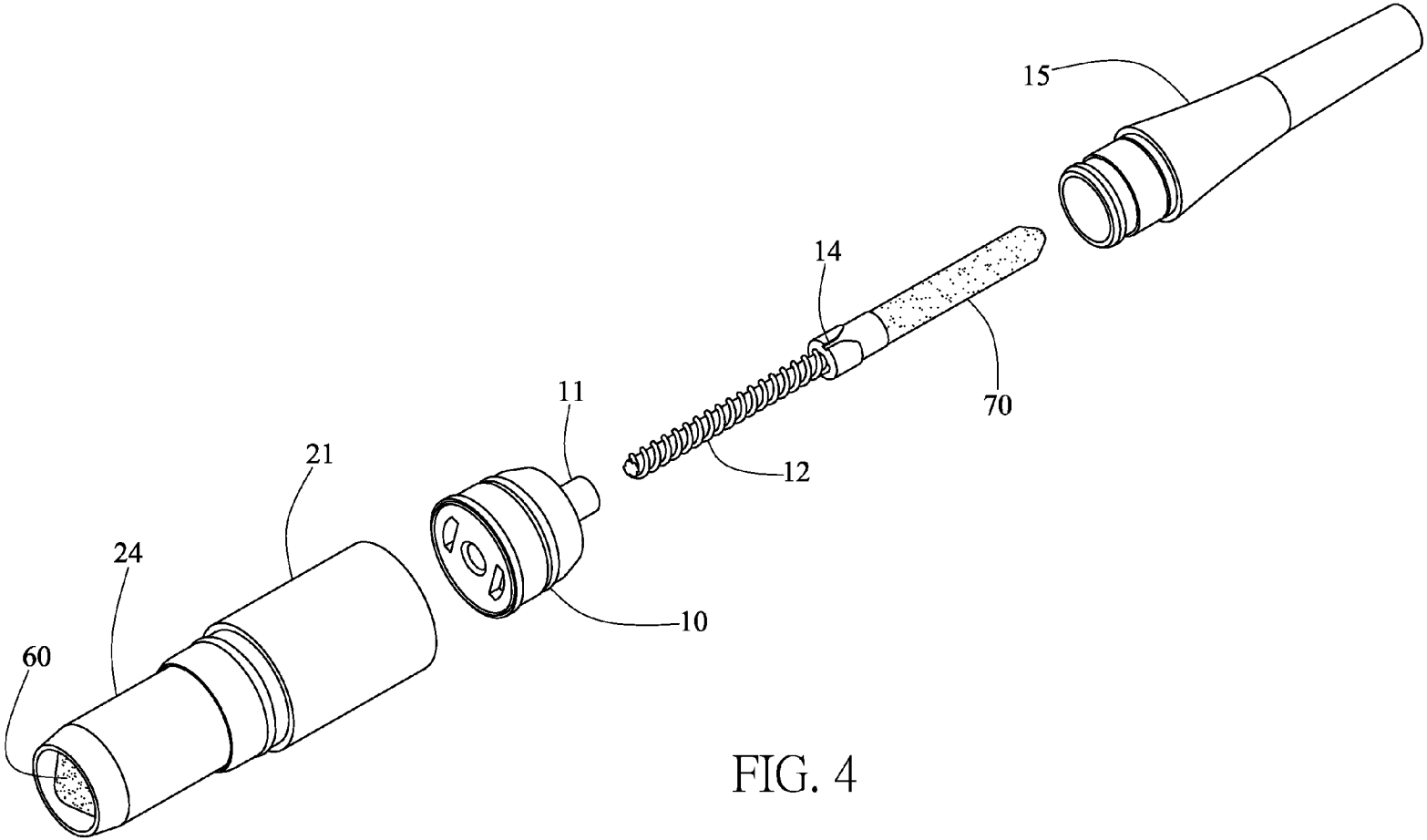
FIG. 4 is an exploded view of some components of the cosmetic applicator.
Figure 5:
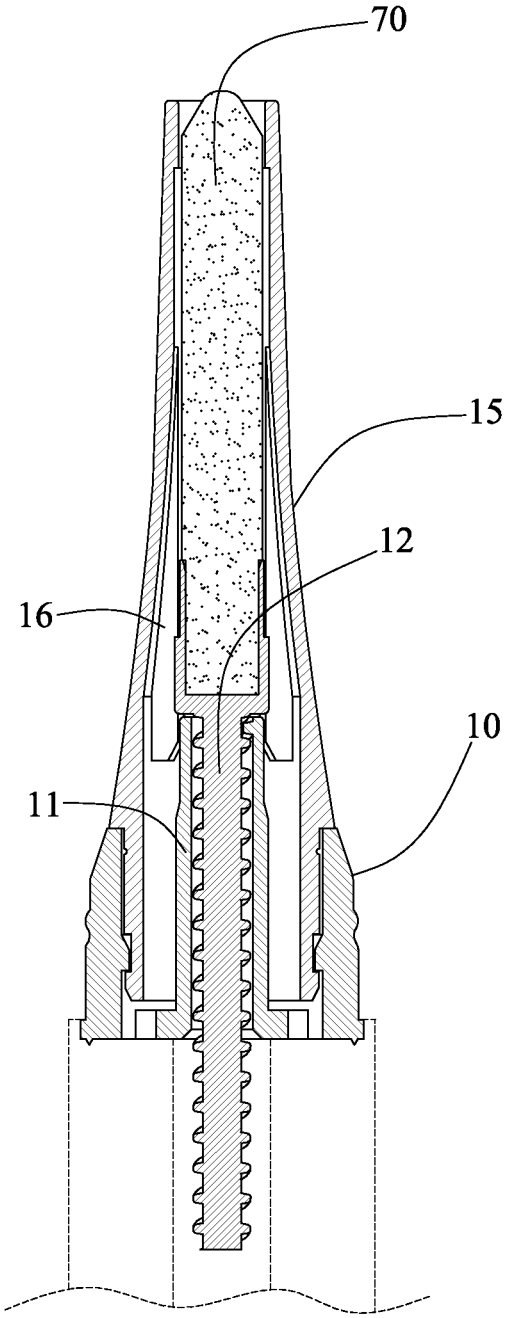
FIG. 5 is an enlarged view of an upper portion of the component under the cap of FIG. 2.
Figure 6:
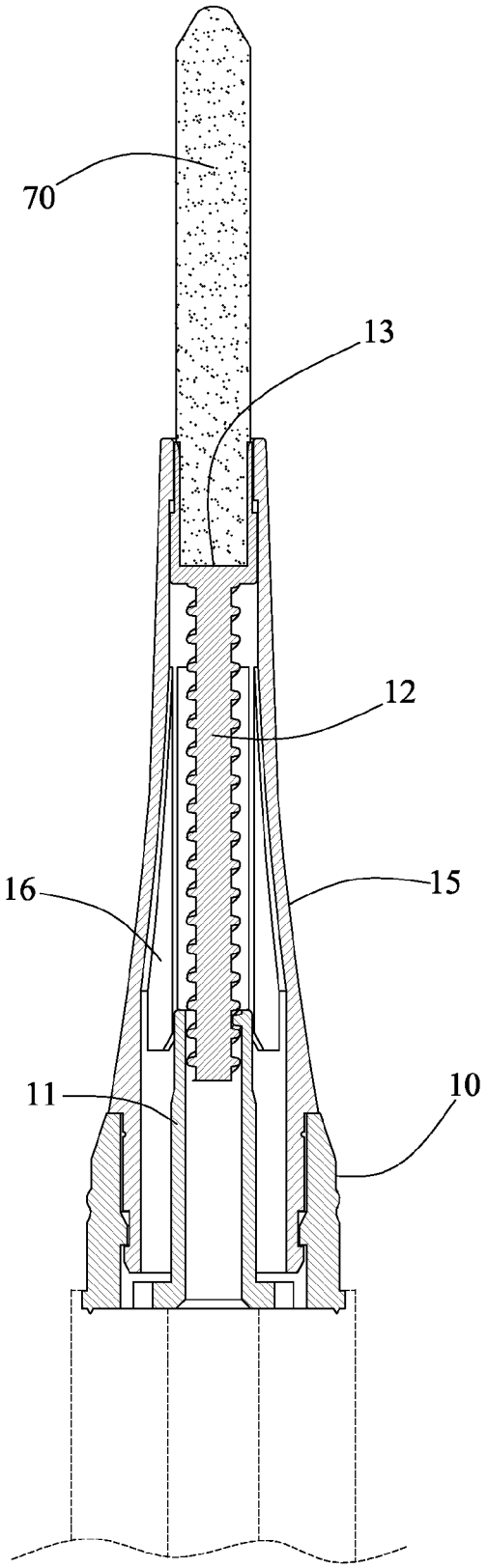
FIG. 6 is a view similar to FIG. 5 showing the projecting cosmetic substance.
Figure 7:
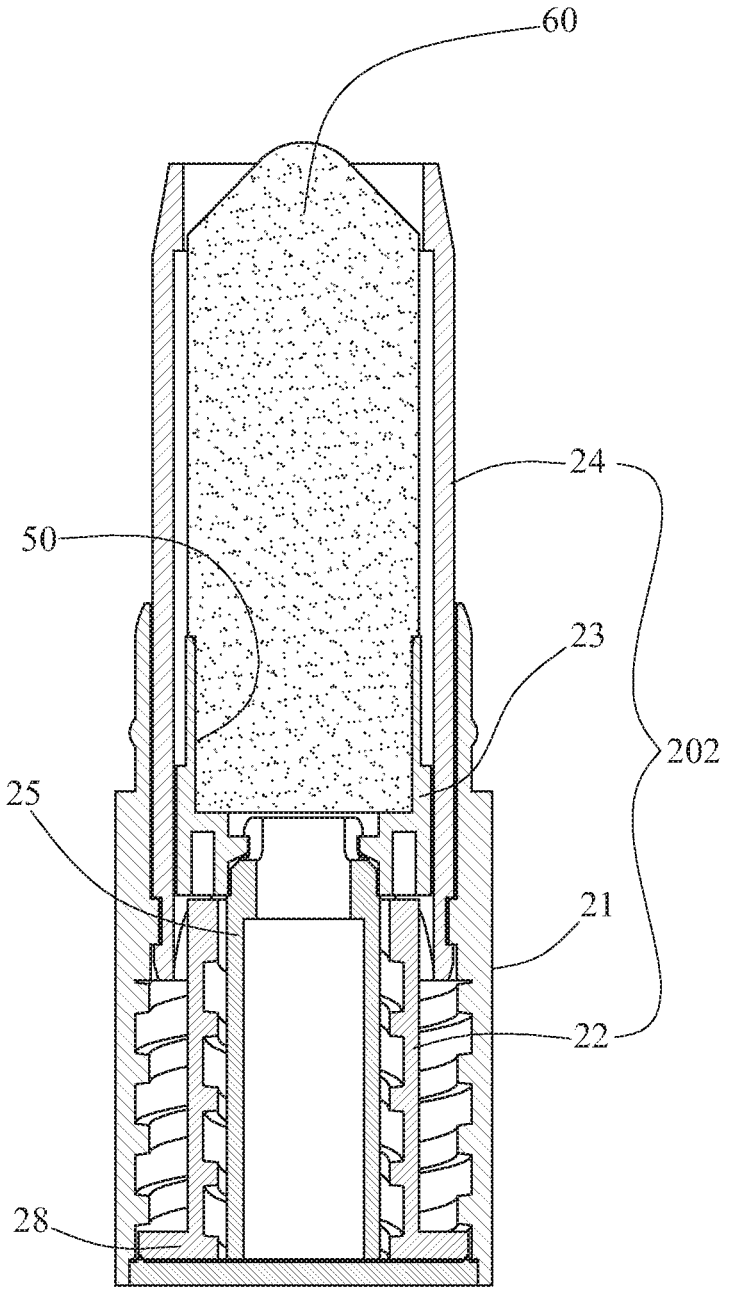
FIG. 7 is an enlarged view of the component under the intermediate case of FIG. 2.
Figure 8:
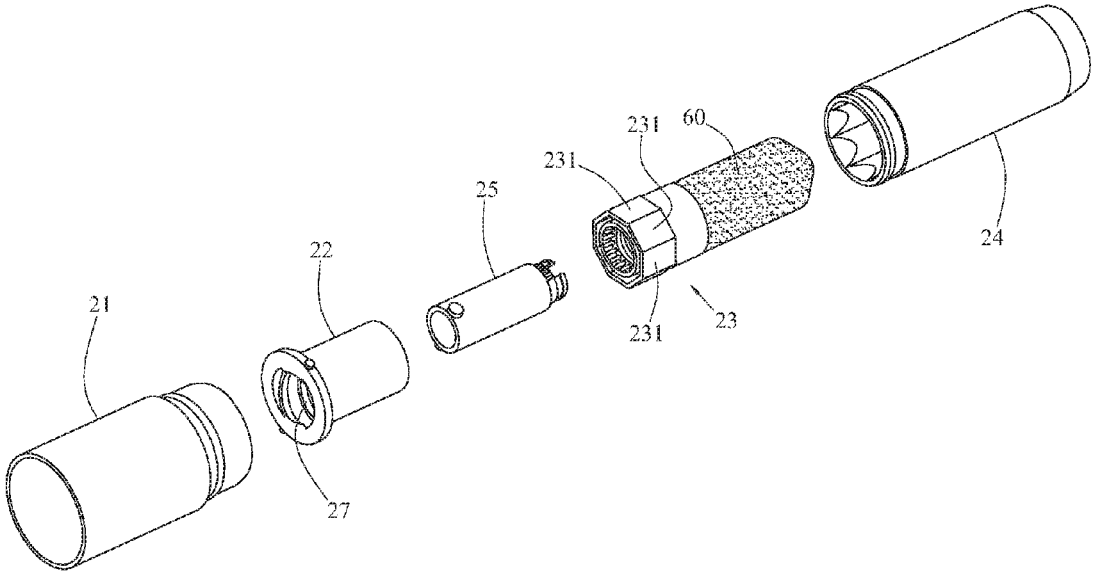
FIG. 8 is an exploded view of the activation assembly and the lip gloss of FIG. 7.
Figure 9:
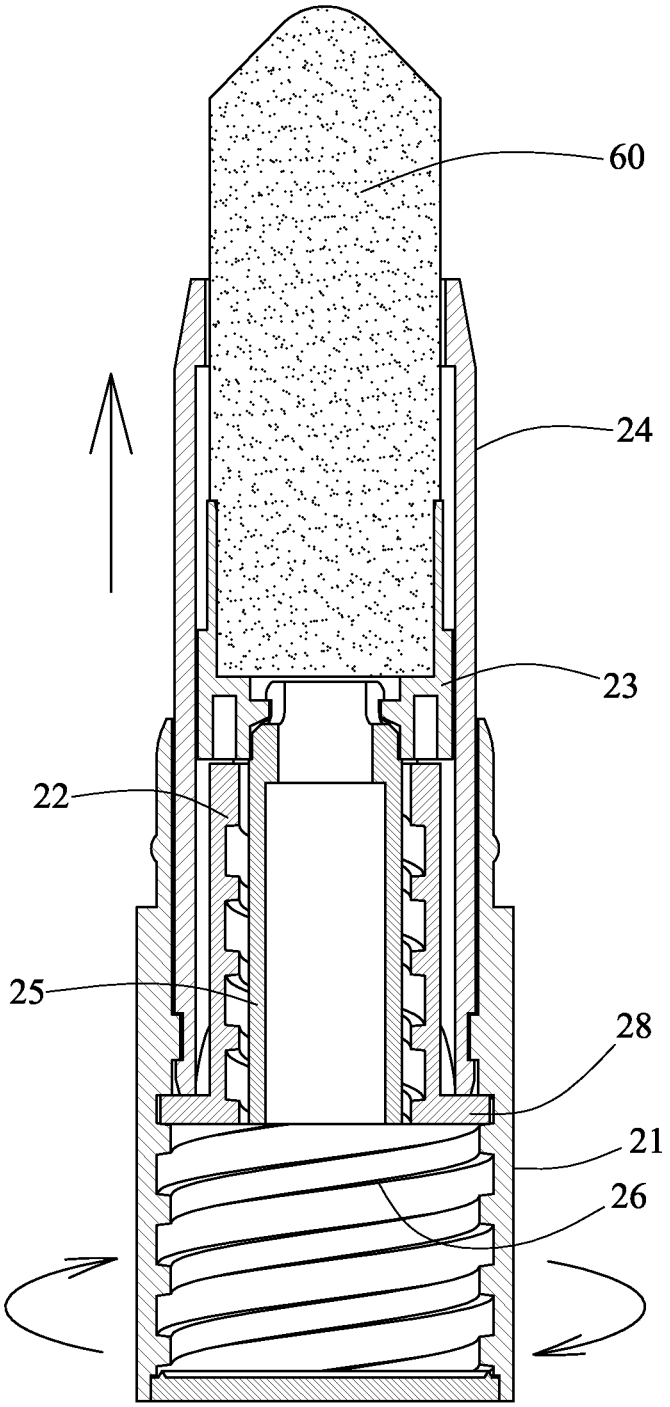
FIG. 9 is a view similar to FIG. 7 where the lip gloss is projecting by rotating the sleeve element.
Figure 10:
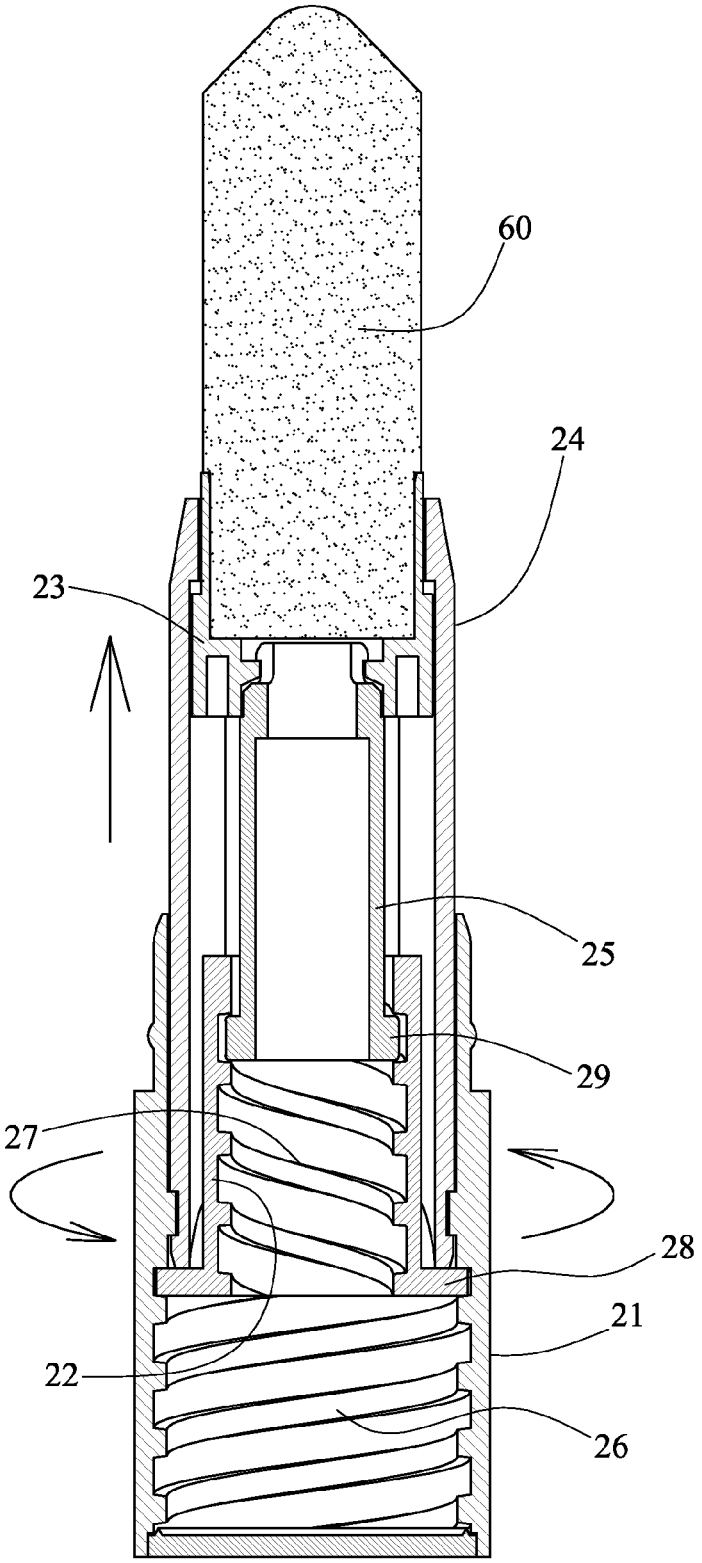
FIG. 10 is a view similar to FIG. 9 where the lip gloss is fully projected by further rotating the sleeve element.
Figure 11:
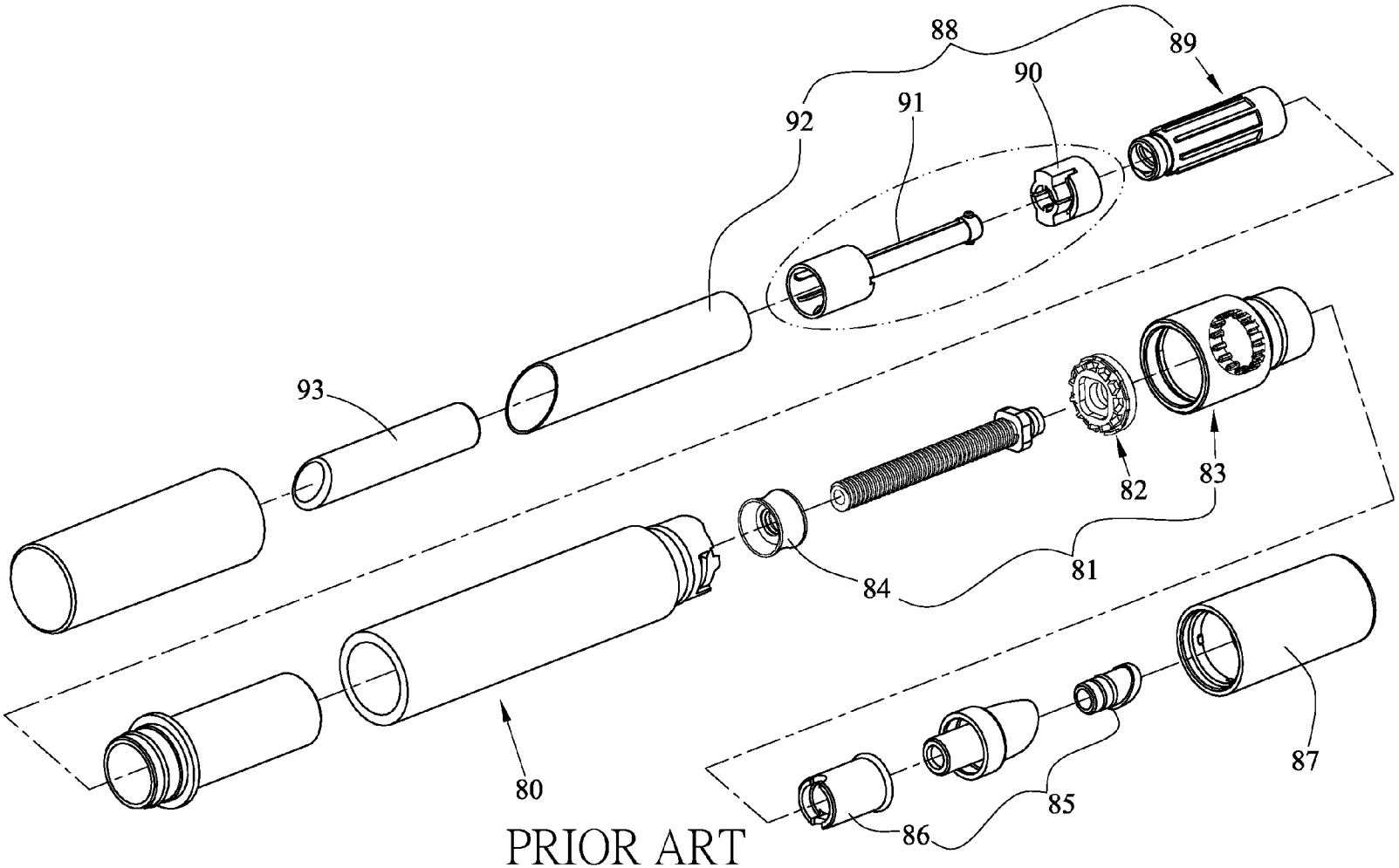
PRIOR ART FIG. 11
FIG. 11 is an exploded view of a conventional cosmetic applicator.

Referring to FIGS. 1 to 10, a multifunctional cosmetic applicator in accordance with the invention comprises the following components as discussed in detail below.

A hollow, cylindrical seat 10 includes an axial sleeve 11 projecting out of the seat 10, a threaded shank 12 moveably disposed through the sleeve 11, a cup 13 formed at one end of the threaded shank 12, a plurality of slits 14 formed on a peripheral surface of the cup 13, a casing 15 secured to the seat 10 and having a bottom extended into the seat 10, and a plurality of ribs 16 on a conic inner surface of the casing 15, the ribs 16 being inserted into the slits 14 to fasten the casing 15 and the cup 13 together.

A first activation assembly 201 includes an exterior case 21, an interior case 22, a sleeve member 23, and a sleeve element 24. An end of the exterior case 21 is secured to a bottom of the seat 10. First external threads 26 are formed on an inner surface of the exterior case 21. An annular first flange 28 is formed at an end of the interior case 22 and configured to move along the first external threads 26. Second external threads 27 are formed on an inner surface of the interior case 22 and spiraled in a direction opposite to that of the first external threads 26. A hollow cylinder 25 is in the interior case 22. An annular second flange 29 is formed at an end of the hollow cylinder 25. The second flange 29 is configured to move along the second external threads 27. The sleeve member 23 is disposed the other end of the hollow cylinder 25.

An intermediate case 30 is hollow and includes an internal partition 31 to divide its interior space into a first portion configured to fasten the exterior case 21 by snapping and receive a portion of the exterior case 21 (i.e., the first activation assembly 201), and a second portion configured to fasten a second activation assembly 202 therein. The first external threads 26 are tapered toward an open end of the exterior case 21. The sleeve member 23 has multiple sides 231 and the sleeve element 24 is configured to fit over the sleeve member 23.

A cap 40 is secured to the seat 10 by snapping. The casing 15 is tapered toward one end to shape as a cone. A tubular carrier 50 is formed with one end of the sleeve member 23. An end of a lip gloss 60 is secured to the carrier 50. An end of a cosmetic substance 70 is disposed in the cup 13. The cosmetic substance 70 is implemented as an eye liner, an eyebrow pencil, or a lip gloss.

In a cosmetic substance 70 application mode, the cap 40 is removed out of the exterior case 21. Next, one hand holds the exterior case 21 and the other hand clockwise rotates the casing 15. The ribs 16 in the slits 14 rotate accordingly. And in turn, the threaded shank 12 moves from the hollow portion of the hollow cylinder 25 toward an open end of the casing 15. As a result, the cosmetic substance 70 projects out of the casing 15 for application. After using the cosmetic substance 70, a user may counterclockwise rotate the casing 15. And in turn, the threaded shank 12 retracts into the hollow cylinder 25 until being stopped. Finally, the cap 40 is put on the seat 10 again. It is envisaged by the invention that the length and the weight of the cosmetic applicator can be decreased greatly, thereby facilitating carry.

In a lip gloss 60 application mode, the activation assemblies 201 are removed out of the intermediate case 30. Next, one hand holds the exterior case 21 and the other hand clockwise rotates the sleeve element 24. And in turn, the sleeve member 23 rotates. Also, the hollow cylinder 25 and the interior case 22 rotate. The interior case 22 thus moves to an open end of the exterior case 21 until the first flange 28 is stopped by the sleeve element 24. As a result, the lip gloss 60 projects out of the sleeve element 24 for application. After length of the lip gloss 60 is decreased due to consumption, the interior case 22 may move toward an open end of the exterior case 21. The movement of the interior case 22 stops when the first flange 28 is stopped by the sleeve element 24. And in turn, a user may counterclockwise rotate the sleeve element 24 to move the second external threads 27 on the inner surface of the interior case 22 in the hollow cylinder 25 toward an open end of the interior case 21. Thus, the lip gloss 60 projects out of the sleeve element 24 for application. After use, the user may counterclockwise rotate the sleeve element 24 to retract the hollow cylinder 25 into the interior case 22 and in turn retract the interior case 22 into the exterior case 21. Next, the exterior case 21 and the intermediate case 30 are fastened together by snapping one end of the intermediate case 30 onto an annular flange of the exterior case 21.

Another lip gloss 60 and another activation assembly 202 are assembled prior to being disposed in a second portion of the intermediate case 30. Thus, internal space of the cosmetic applicator of the invention is fully used to store more cosmetic substance therein. Further, the lip gloss 60 can be projected further for application after being consumed. This two-time projection of the lip gloss 60 enables the lip gloss 60 to be fully consumed. Furthermore, the structure comprising two threaded sleeves and the threaded shank 12 configured to receive in the hollow cylinder 25 can shorten the length of the cosmetic applicator. In addition, the two lip glosses 60 can have different colors and in one configuration the cosmetic substance 70 is an eyebrow pencil. All of these improvements facilitate carrying and use.

While the invention has been described in terms of preferred embodiments, those skilled in the art will recognize that the invention can be practiced with modifications within the spirit and scope of the appended claims.

What is claimed is:

1. A cosmetic applicator comprising:

a hollow seat including a projecting axial sleeve, a threaded shank moveably disposed through the sleeve, a cup formed at an end of the threaded shank, and a plurality of slits formed on a peripheral surface of the cup;

a casing secured to the seat and having a bottom extended into the seat, the casing being configured to receive the threaded shank and including a plurality of ribs on a conic inner surface, the ribs being inserted into the slits to fasten the casing and the cup together;

a first activation assembly including an exterior case having an end secured to a bottom of the seat, an interior case, a sleeve member, a sleeve element, first external threads formed on an inner surface of the exterior case, a first flange formed at an end of the interior case and configured to move along the first external threads, second external threads formed on an inner surface of the interior case and spiraled in a direction opposite to that of the first external threads, a hollow cylinder disposed in the interior case, and a second flange formed at a first end of the hollow cylinder and configured to move along the second external threads wherein the sleeve member is disposed at a second end of the hollow cylinder; and a hollow intermediate case having a first end secured onto the first activation assembly, and a second end secured onto a second activation assembly, the second end of the intermediate case being opposite to the first end of the intermediate case.

2. The cosmetic applicator of claim 1, wherein the first external threads is tapered toward an open end of the exterior case.

3. The cosmetic applicator of claim 1, wherein the sleeve member has multiple sides and the sleeve element is configured to fit over the sleeve member.

4. The cosmetic applicator of claim 1, further comprising a cap releasably secured to the seat.

5. The cosmetic applicator of claim 1, wherein the intermediate case includes an internal partition to divide its interior space into two portions.

6. The cosmetic applicator of claim 1, wherein the casing is tapered toward an end to shape as a cone.

7. The cosmetic applicator of claim 1, further comprising a tubular carrier mounted at an end of the sleeve member.

8. The cosmetic applicator of claim 1, further comprising a cosmetic substance having an end disposed in the cup, the cosmetic substance being as an eye liner, an eyebrow pencil, or a lip gloss.

* * * * *